United States Patent [19]

Sparks

[11] Patent Number: 5,054,507

[45] Date of Patent: Oct. 8, 1991

[54] PORTABLE BEACH CACHE

[76] Inventor: Terry L. Sparks, 14 Vittoria St., Laguna Niguel, Calif. 92677

[21] Appl. No.: 565,805

[22] Filed: Aug. 10, 1990

Related U.S. Application Data

[63] Continuation of Ser. No. 362,754, Jun. 9, 1990, abandoned.

[51] Int. Cl.[5] ..... E04H 15/18

[52] U.S. Cl. ..... 135/97; 135/113; 135/902; 160/135

[58] Field of Search ..... 135/87, 97, 112, 117, 135/902, 113, 109; 52/71, 63; 160/135, 231.1, 231.2; 256/26, 28, 29

[56] References Cited

U.S. PATENT DOCUMENTS

| | | | |
|---|---|---|---|
| 2,120,861 | 6/1938 | Hastings | 135/87 X |
| 2,196,544 | 4/1940 | Bagley | 135/87 X |
| 2,208,458 | 7/1940 | Julian et al. | 135/87 |
| 2,274,047 | 2/1942 | Derman | 160/229 |
| 2,521,768 | 9/1950 | Adams | 135/87 X |
| 2,525,683 | 10/1950 | Kedly | 160/135 X |
| 2,619,101 | 11/1952 | McGerry et al. | 135/87 |
| 2,771,088 | 11/1956 | Soldan | 135/87 |
| 2,784,779 | 3/1957 | Knipper et al. | 160/135 |
| 2,981,256 | 4/1961 | Besnah | 135/87 X |
| 3,441,037 | 4/1969 | Transeau | 135/904 X |
| 3,566,556 | 3/1971 | Nichols | 52/71 |
| 3,592,289 | 7/1971 | Aysta | 160/135 |
| 4,085,789 | 4/1978 | Steiner et al. | 160/135 |
| 4,243,340 | 1/1981 | MacGregor | 40/312 |
| 4,407,319 | 10/1983 | Shultz et al. | 135/87 |
| 4,599,754 | 7/1986 | Mars et al. | 135/96 X |
| 4,770,088 | 9/1988 | Kistner | 135/90 X |

*Primary Examiner*—David A. Scherbel
*Assistant Examiner*—Lan Mai
*Attorney, Agent, or Firm*—Stetina and Brunda

[57] ABSTRACT

A portable beach cache having a plurality of fabric panels and rigid support members arranged in a picture frame configuration for sheltering the user from wind and wind-blown debris, such as sand. Fold-out feet provide support in soft sand. A handle is provided to simplify carrying and a hook and loop strap secures the portable beach cache in its stowably disposed position. The portable beach cache is compact when folded and light enough to be easily carried by hand. A second embodiment is disclosed wherein the portable beach cache has a single screen panel and a plurality of rigid vertical support members and elongate rods. The screen is attached between two of the vertical support members in the fashion of a tennis net. The vertical support members have pointed ends which are driven into the ground. The elongate rods are then attached to the vertical members to provide strength and to stretch the screen panel taut. The portable beach cache of the second embodiment can be easily stored by disassembly and placing the horizontal support members along side the vertical members and then rolling the vertical and horizontal members up inside the screen. The rigid support members of the second embodiment may be disassembled to provide storage.

3 Claims, 2 Drawing Sheets

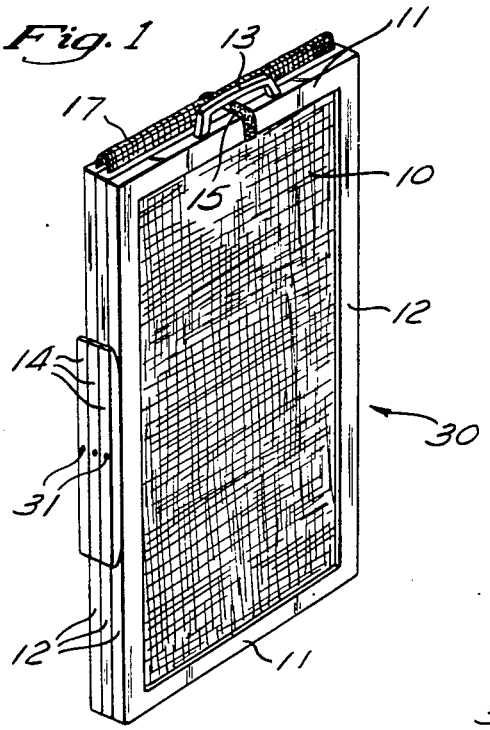
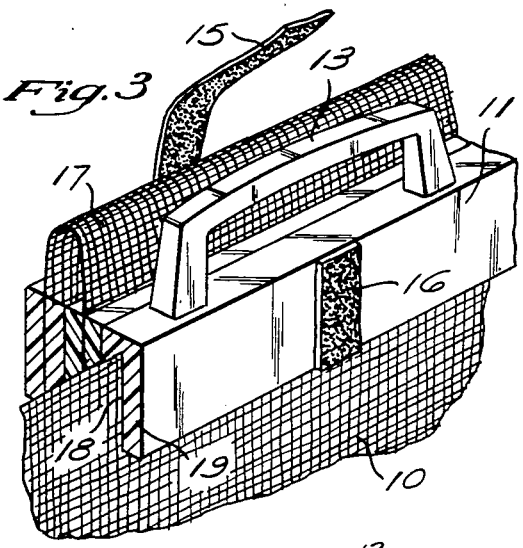
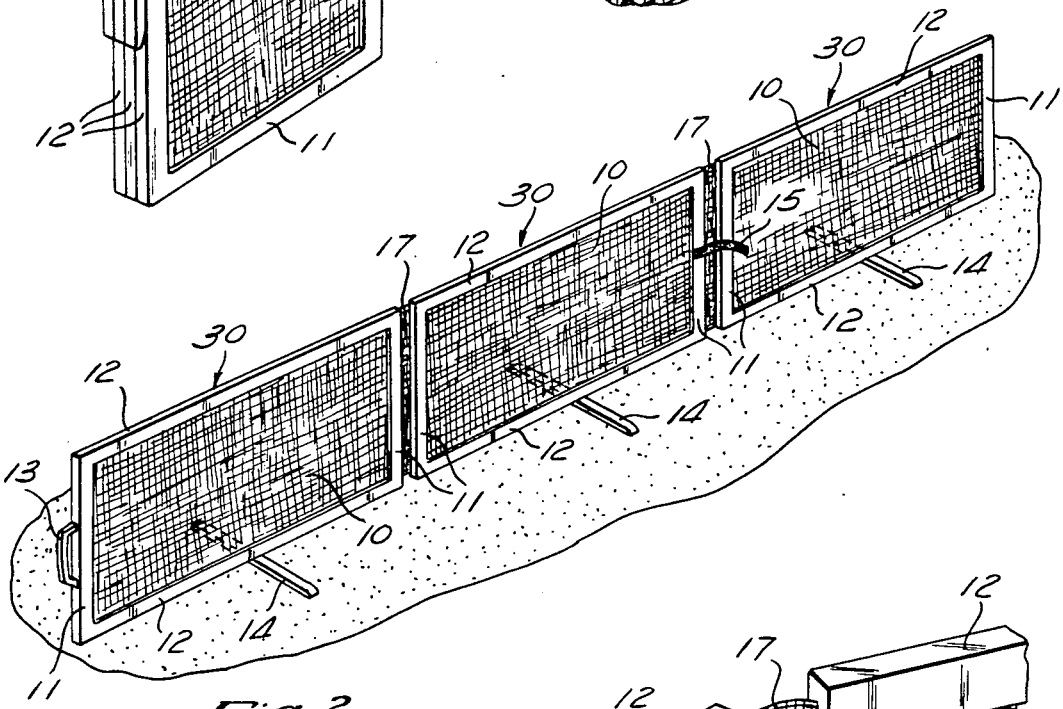
Fig. 2
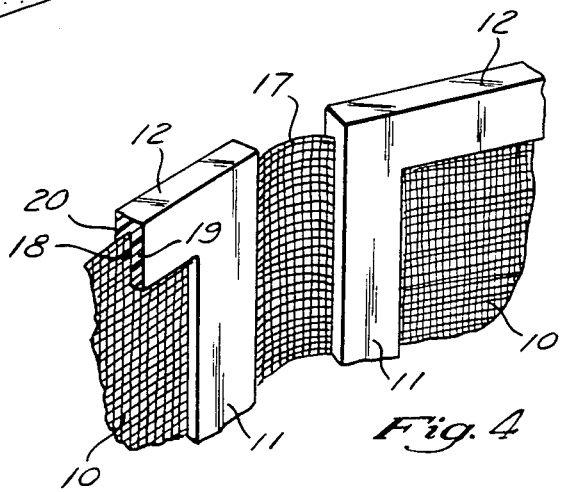
Fig. 4

PORTABLE BEACH CACHE

This application is a continuation of application Ser. No. 362,754, filed 6/9/90, now abandoned.

FIELD OF THE INVENTION

The present invention relates generally to wind screens and more particularly to an improved portable beach cache. In a first embodiment the beach cache is formed having a plurality of screen panels and rigid support members arranged in a picture frame configuration for sheltering the user from wind and wind-blown debris, such as sand. Fold-out feet provide support in soft sand. A handle is provided to simplify carrying and a hook and loop strap secures the portable beach cache in its stowed configuration.

In a second embodiment, the portable beach cache comprises a single screen panel and a plurality of rigid vertical support members and horizontal elongate bars. The screen panel is attached between two of the vertical support members, in the fashion of a tennis net. The vertical support members have pointed ends which are adapted to be driven into the ground. The horizontal elongate bars are then attached to the vertical members to provide strength and to stretch the screen panel taut. The portable beach cache of the second embodiment can be easily stored by disassembling and placing the elongate bars along side the vertical support members and then rolling the vertical support members and elongate bars up inside the screen panel.

BACKGROUND OF THE INVENTION

Wind screens are well known which provide protection for a user from wind and windblown objects, such as sand. These wind screens are common at the beach and in windy areas where sand is likely to be blown into the air. Prior art wind screens are generally large fixed screens typically in the form of walls or fences. Wood lattice work is often used to form a wind screen. Chain-link fences with wood, metal, or plastic slats inserted through the rows of links are also common.

While such fixed wind screens are very effective in providing protection against the wind and blowing objects, they are of course expensive, stationary structures which are impossible to transport. This makes it necessary for those who find themselves at the beach on windy days to either seek the shelter of a fixed wind screen or else suffer the discomfort and inconvenience of wind and blowing sand. Occasionally no suitable shelter is to be found, thereby forcing beachgoers to forgo their enjoyment of the beach.

Recognition of the problem of inconvenience and discomfort due to wind and wind-blown objects, such as sand, has been recognized to a limited extent by the prior art. Beach umbrellas provide some shelter from the wind. However, their primary purpose is to shelter the user from the sun. Consequently, even when a beach umbrella is laid on its side to provide the maximum possible protection from wind, it still produces unsatisfactory results. This is because the beach umbrella is round and therefore does not provide a good barrier against the wind along the ground since it touches the ground at only one point. Much of the wind simply blows around the beach umbrella. Beach umbrellas were also primarily intended for use by groups of people, and are somewhat bulky and too heavy to be easily carried by a single individual.

As such, although the prior art has recognized to a limited extent the problem of blowing wind and wind-blown objects, the proposed solutions have to date been ineffective in providing a satisfactory remedy. Thus, there exists a substantial need in the art for a portable wind screen which is both light enough to be easily transported and effective in protecting the user from the wind and wind-blown objects.

SUMMARY OF THE PRESENT INVENTION

The present invention specifically addresses and alleviates the above-mentioned deficiencies. More particularly in a first embodiment, the present invention comprises a portable beach cache having a plurality of screen panels and rigid support members arranged in a picture frame-like configuration for sheltering the user from the wind and wind-blown debris, such as sand. Rotatable fold-out feet, i.e. stabilizers, are mounted to one or more of the support members to provide proper support in soft sand. A handle is provided to simplify carrying and a hook and loop strap secures the portable beach cache in a stowed configuration. The portable beach cache is compact when folded and light enough to be easily carried by hand.

In a second embodiment the present invention comprises a portable beach cache having a single elongate screen panel and a plurality of rigid vertical support members and elongate rods. The screen panel is attached between two of the vertical support members, in the fashion of a tennis net. The vertical support members have pointed ends which may be manually driven into the ground. The elongate rods are then attached to the vertical members to provide strength and to stretch the screen panel taut. The portable beach cache of the second embodiment can be easily stored by disassembling and placing the elongate rods along side the vertical members and then rolling the vertical an horizontal members up inside the screen panel.

The portable beach cache of the present invention provides a convenient means of obtaining shelter from the wind and blown sand at the beach. Since it is light and easy to set up, the user will be much more likely to carry it to the beach rather than carry a heavy, bulky beach umbrella. Therefore, the user can enjoy the beach under conditions of light to moderate wind when he otherwise would not be able to.

It is therefore an object of the present invention to provide a portable beach cache which effectively shelters the user from light to moderate winds and wind-blown debris.

It is a further object of the present invention to provide a lightweight and truly portable wind screen.

It is a further object of the present invention to provide a portable beach cache which is easy to set up.

These as well as other future objects and advantages will be apparent from the following description and drawings. It is understood that changes in the specific structure shown and described may be within the scope of the claims without departing from the spirit of the invention.

BRIEF DESCRIPTION OF THE DRAWINGS

FIG. 1 is a perspective view of a first embodiment of the portable beach cache depicted in a stowed configuration.

FIG. 2 is a perspective view of the first embodiment of the portable beach cache depicted in its operative configuration;

FIG. 3 is an enlarged perspective view of the first embodiment of the portable beach cache showing its handle and hook and loop strap;

FIG. 4 is an enlarged perspective view of the first embodiment of the portable beach cache showing its fabric hinge;

BRIEF DESCRIPTION OF THE PREFERRED EMBODIMENTS

Figure 5:
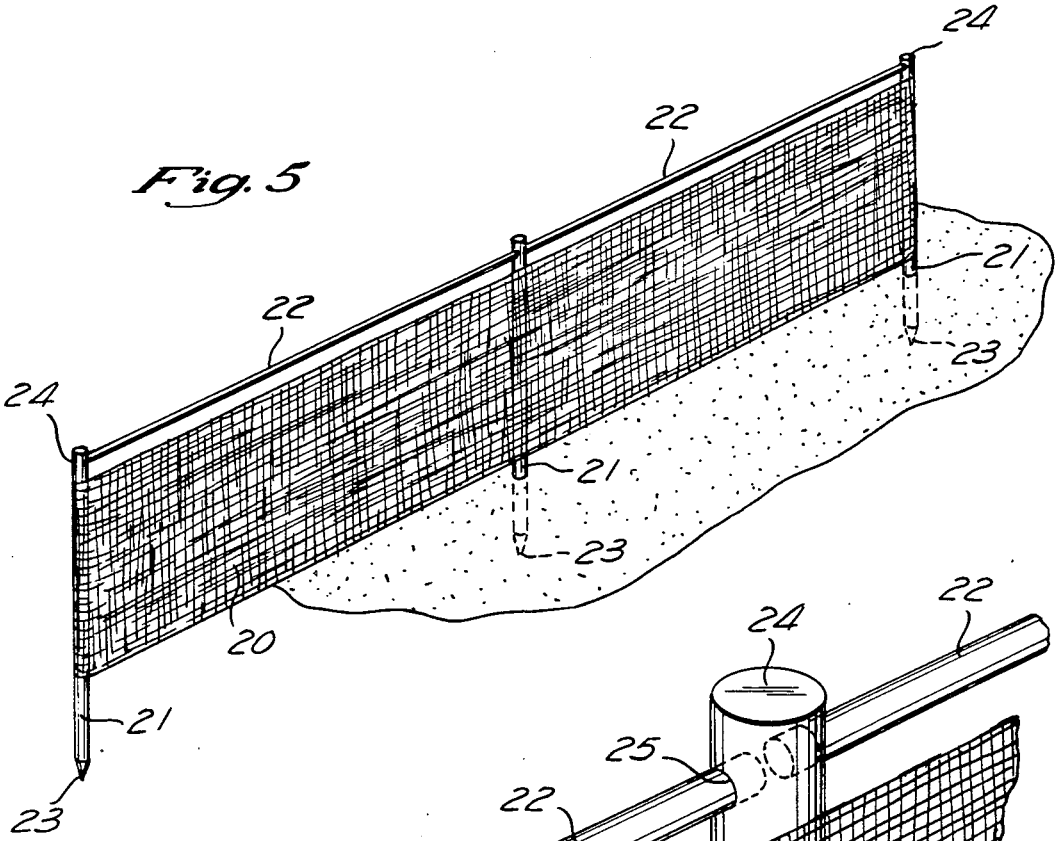
FIG. 5 is a perspective view of a second embodiment of the portable beach cache depicted in its operative configuration.

FIGS. 1–4 illustrate a first embodiment of the portable beach cache of the present embodiment. As best shown in FIG. 2, a series of picture frame like screen panels 30 are comprised of screens 10, made either of metal or fabric, and enclosed by vertical members and horizontal members 12. A handle 13 is secured to one of the uppermost vertical members 11. One or more feet 14 are pivotally attached to each of the lowermost horizontal frame members 12. A hook and loop strap 15 secures the portable beach cache in the stowably disposed position.

The vertical frame members 11, the horizontal frame members 12, the handle 13, and the feet 14 can be made of wood. Alternatively, these parts can be made of injection molded plastic to reduce weight and lower manufacturing costs. Preferably, each panel may be formed having dimensions of approximately 12 to 18 inches high and 24 to 32 inches long, however, alternative sizing is contemplated herein.

FIG. 2 shows the portable beach cache in its op®rably disposed configuration. Each of the feet 14 have been rotated about a pivot, shown in FIG. 1, to a position perpendicular to its corresponding lower horizontal member 12. These feet 14 provide a stable support structure for the portable beach cache on loose sand. They thereby prevent the portable beach cache from overturning during light and moderate winds.

As shown in FIG. 3, a handle 13 is attached to an uppermost vertical frame member 11. A hook and loop mating surface 16 is also attached to the uppermost vertical member 11.

Each of the frame members 11 and 12 has a slot along its inner surface into which the periphery of the screen 10 is secured. If the frame members 11 and 12 are constructed of wood, then nails or staples can be used to clamp the first 19 and second 20 surface together to secure the screen 10 therebetween. If the frame members are made of injection molded plastic, then suitable fasteners, such as screws, or bolts with nuts, can be used to secure the screen therebetween. Alternatively, in either oase an adhesive can be used to secure the screen 10 to the frame members 11 and 12.

As shown in FIG. 4, a portion of the screen 17 is located between two vertical frame members 11 and serves as a hinge. If the vertical and horizontal frame members 11 and 12 are injection molded out of plastic, then a thin flexible plastic web sized and positioned the same as the screen 17 can function as a living hinge. Prefabricated hinges can also be used between panels.

In operation, the portable beach cache is transported and stored in its stowably disposed configuration as illustrated in FIG. 1. The hook and loop strap 15 is connected to its mating surface 16, best shown in FIG. 3, to secure the portable beach cache in the stowably disposed configuration. When in this stowably disposed position, the lightweight portable beach cache is small enough to transport in a car and light enough to carry by hand.

When desired for use, the portable beach cache is deployed to its operative configuration by first unfastening the hook and loop strap 15 from its mating surface 16. Next the portable beach cache is unfolded to extend to its full length. The feet 14 are rotated to a position approximately 90 degrees from their stowably disposed position. The portable beach cache is then placed upright with its feet 14 on the sand, as shown in FIG. 2.

Figure 6:
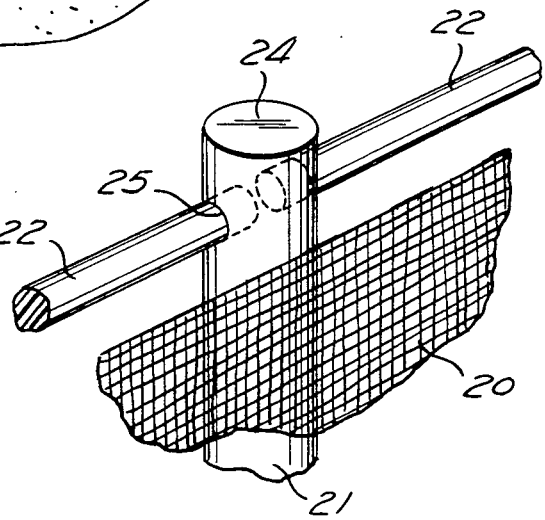
FIG. 6 is an enlarged perspective view of a vertical member of the second embodiment of the portable beach cache showing the attachment of two horizontal members to a single vertical member.
Figure 7:
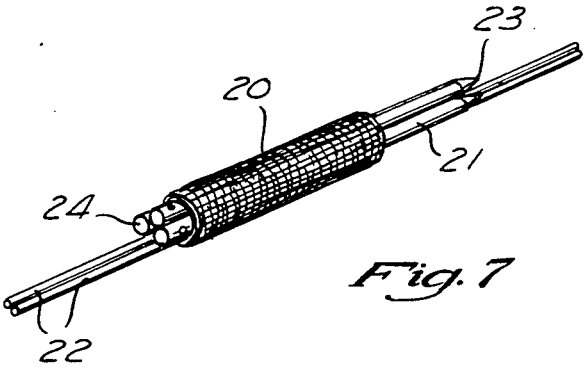
FIG. 7 is a perspective view of the second embodiment of the portable beach cache depicted in its stowed configuration.

A second embodiment of the portable beach cache is illustrated in FIGS. 5–7 of the drawings. As best shown in FIG. 5, a screen 20 is attached to vertical members 21. If the vertical support members 21 are made of wood, then the screen 20 can be stapled to the vertical support members 21. Otherwise, an adhesive or any other suitable attachment means may be utilized. Each vertical member 2 has a sharpened end 23 and a blunt end 24. Elongate rods 22 extend between vertical members 21. As shown in FIG. 6, the ends of the elongate rods 22 will fit into holes 25 of the vertical members 21.

FIG. 7 shows the portable beach cache of the second embodiment in its stowed configuration. In this position the screen 20 is wrapped around each of the vertical members 21 and the elongate rods 22. This provides a compact configuration for storage and transportation.

The vertical members 21 and the elongate rods 22 can be made of wood, plastic, or a lightweight metal, such as aluminum.

In operation, the portable beach cache is maintained in its stowably disposed position as shown in FIG. 7. When desired for use the portable beach cache of the second embodiment is deployed by first unwrapping the screen from the elongate rods 22 and vertical members 21. The portable beach cache is then stretched out lengthwise and each of the vertical members 21 is driven into the sand with its sharpened end 23 downward. A hammer or mallet may be used to strike the blunt end 24 of each vertical member 21 in order to drive that vertical member into the ground, although this will seldom be necessary in soft beach sands. After each vertical member 21 has been driven into the sand, an elongate rod 22 is attached between each pair of adjacent vertical members 21. This is accomplished by placing the ends of an elongate rod 22 into the holes 25 of both adjacent vertical members 21. Attaching the elongate rods 22 will stretch the screen 20 tight.

The portable beach cache of the second embodiment will function in the same manner as the portable beach cache of the first embodiment to shelter the user from the effects of wind and blown debris, such as sand.

In either embodiment of the portable beach cache a fabric may be used as the screen. A fabric should be choosen which has, small apertures in it, like those of a screen. The apertures must be small enough to prevent the wind from blowing foreceably therethrough. They should also be large enough to permit some wind to pass and thereby help prevent the portable beach cache from blowing over and also to diffuse the power of the wind. Apertures having a diameter of between 0.010 inch and 0.250 inch are appropriate. The spacing between the holes should be approximately the same as the apertures diameter. Alternatively, a wire or filament mesh may be used as a screen.

The use of a wire or filament mesh results in apertures which are not round in shape. However, the above dimensions are still appropriate if measured as the average distance across the aperture instead of the diameter of a circular aperture. For the purposes of this application, the average distance across a non-circular aperture shall be considered equivalent to the diameter of a circular aperture.

The sizing and spacing of the apertures formed in the screen are crucial to the practice of the present invention. The use of apertures which are sized too small and/or are formed too far apart will not diffuse the power of the wind and will consequently permit the wind to blow the portable beach cache over. By sizing the apertures large enough and forming the apertures close enough together, the power of the wind is diffused since a portion of the wind is permitted to blow through the screen 10. That is, the full force of the wind is not longer available to blow the portable beach cache over.

Sizing the apertures too large and/or spacing the apertures too close together would permit the wind to blow forcible therethrough. This, of course, would tend to eliminate the beneficial effects of the portable beach cache. Therefore, the apertures must be sized enough and spaced far enough apart to prevent the wind from blowing forcibly therethrough. The use of a screen as opposed to a solid panel has not only the advantage of making the portable beach cache more stable in light to moderate winds, but also helps considerably in lessening the effects of the wind. By permitting some of the wind to blow through the screen, the power of the wind is diminished. If the power of the wind is not diffused this way, then the wind will merely blow over the top of the portable beach cache and little will be accomplished.

It is understood that the exemplary portable beach cache described herein and shown in the drawings represents only a presently preferred embodiment of the invention. Indeed, various modifications and additions may be made to such embodiment without departing from the spirit and scope of the invention. For example, the screen 10 and the rigid support members 11 and 12 of the screen panels of the first embodiment may be formed as an integral unit by injection molding or various other manufacturing processes. Screen panels, which utilize slats in the fashion of a picket fence, or lattice work, such as is common on the construction of gazebos and patio walls, are contemplated. The arrangement of the screen panel's support members can vary widely. Configurations where the screen material is supported on two opposite ends by support members, and the support members themselves are held in position by a third support member, are also contemplated. These modifications would result in frame constructions having the general appearance of the letter "H", where two parallel members are separated and supported by a third member which is generally perpendicular to the two parallel members. Thus, these and other modifications and additions may be obvious to those skilled in the art and may be implemented to adapt the present invention for use in a variety of different applications.

What is claimed is:

1. A portable beach cache for sheltering the user from the wind and wind-blown debris comprising:

(a) a plurality of screens formed to fit within a corresponding plurality of frames, said screens formed of a material adapted to diffuse the wind's power;

(b) a rigid frame, having two horizontal support members and two vertical support members, attached about the periphery of each of said screens for providing support to said screens;

(c) a hinge for pivotally connecting said vertical support members of said rigid frames, said hinge being comprised of the same material as said screen, said rigid frames being operable between a stowably disposed position and an operably disposed position;

(d) at least two feet pivotally attached to at least one of said horizontal support members for supporting the portable beach cache upon the ground, said feet not extending substantially beneath the surface of the ground; and (e) a plurality of apertures formed in said screens, said apertures being sized between 0.010 inch and 0.250 inch in diameter and spaced apart by approximatelythe length of their diameter to prevent the wind from blowing forcibly therethrough while permitting a portion of the wind to blow non-forcibly therethrough such that the power of the wind is diffused in order to prevent the portable beach cache from blowing over;

(f) a latch attached to the rigid frame for securing the portable beach cache in the stowably disposed position; and (g) a handle attached to the rigid frame for carrying the portable beach cache when it is in the stowably disposed position.

2. The portable beach cache as recited in claim 1 wherein said latch for securing the portable beach cache in the stowably disposed position is a hook and loop fastener.

3. A portable beach cache for sheltering the user from the wind and wind-blown debris comprising:

(a) a plurality of screens formed to fit within a corresponding plurality of frames, said screens formed of a material adapted to diffuse the wind's power;

(b) a rigid frame, having two horizontal support members and two vertical support members, attached about the periphery of each of said screens for providing support to said screens;

(c) a hinge for pivotally connecting said vertical support members of said rigid frames, said hinge being comprised of the same material as said screen, said rigid frames being operable between a stowably disposed position and an operably disposed position;

(d) at least two feet pivotally attached to at least one of said horizontal support members for supporting the portable beach cache upon the ground, said feet not extending beneath the surface of the ground; and (e) a plurality of apertures formed in said screens;

(f) wherein said apertures in said screen are sized between 0.010 inch and 0.250 inch in diameter and are spaced apart by approximately the length of their diameter;

(g) a latch attached to the rigid frame for securing the portable beach cache in the stowably disposed position; and (h) a handle attached to the rigid frame for carrying the portable beach cache when it is in the stowably disposed position.

* * * * *